United States Patent [19]

Ives et al.

[11] 4,090,549

[45] May 23, 1978

[54] METHOD AND MECHANISM FOR DETERMINING FORCES ON A SOLIDIFYING CASTING

[75] Inventors: Kenneth D. Ives, Plum Borough; Ronald S. Vranka, Monroeville Borough, both of Pa.

[73] Assignee: United States Steel Corporation, Pittsburgh, Pa.

[21] Appl. No.: 488,117

[22] Filed: Jul. 12, 1974

[51] Int. Cl.[2] ..... B22D 11/16

[52] U.S. Cl. ..... 164/4; 164/150; 164/413; 164/442

[58] Field of Search ..... 164/82, 282, 4, 150, 164/154, 151, 413, 442

[56] References Cited

U.S. PATENT DOCUMENTS

| | | | |
|---|---|---|---|
| 3,557,865 | 1/1971 | Gallucci et al. | 164/282 |
| 3,752,210 | 8/1973 | Gallucci et al. | 164/282 |
| 3,753,461 | 8/1973 | Gallucci et al. | 164/282 |
| 3,757,848 | 9/1973 | Scholz et al. | 164/282 |
| 3,776,298 | 12/1973 | Vogt | 164/282 |
| 3,812,900 | 5/1974 | Bollig et al. | 164/282 |

*Primary Examiner*—Francis S. Husar
*Assistant Examiner*—Gus T. Hampilos
*Attorney, Agent, or Firm*—Walter P. Wood

[57] ABSTRACT

A method and mechanism for determining forces on a casting as it solidifies in a continuous-casting machine. A plurality of roll-pairs of an otherwise conventional curved roll-rack are equipped with means (e.g. load cells) which show the compressive load exerted by the different roll-pairs on the casting. The roll-pair beyond which no further upward trend in compressive load occurs marks the plane at which the casting first solidifies throughout its cross section, since beyond this plane the casting no longer has a liquid core tending to bulge the skin and separate the rolls. Whenever the load on a roll-pair departs substantially from the norm, the indication is that the rolls of this pair are improperly gapped (that is, the spacing between roll faces is either too great or too little).

11 Claims, 4 Drawing Figures

METHOD AND MECHANISM FOR DETERMINING FORCES ON A SOLIDIFYING CASTING

This invention relates to an improved method and mechanism for determining forces on a casting as it solidifies in a continuous-casting machine.

In a conventional continuous-casting operation, liquid metal is poured through an open-ended water-cooled mold, which oscillates in a substantially vertical direction. A casting emerges continuously from the lower end of the mold. As the casting leaves the mold, it has only a thin solidified skin and a liquid core. In installations which utilize a straight-sided mold, the casting travels successively through a guide roll-rack beneath the mold, between power driven pinch rolls, through a bending roll unit, and thence through a curved roll-rack which changes its direction of travel from substantially vertical to horizontal. The casting acquires a curved set as it is bent and hence passes through a straightener following the curved roll-rack before it is cut to discrete lengths. Some operations utilize a curved mold and the casting has a curvature as it emerges from the mold. In such installations the casting enters the curved roll-rack directly from the mold, but the principles of our invention are equally applicable.

After the casting leaves the mold, intense water sprays are applied to its surface to promote solidification of its core. At some location below the mold the casting solidifies throughout its cross section. In modern low-head continuous-casting installations the plane of complete solidification (that is, the location at which a casting first solidifies throughout its cross section) lies within the curved roll-rack near its exit end or even beyond the curved roll-rack in the straightener or in a horizontal roll-rack following the straightener. In any one continuous-casting machine the location of the plane of complete solidification varies with the casting speed, the volume of water sprayed on the surface of the casting, and the composition of the metal. As long as the casting has a liquid core, it must be closely confined to prevent its skin from bulging.

If the skin bulges immediately ahead of the plane of complete solidification, internal center-line defects known as "core cracks" are likely to occur in the casting. Core cracks often result when the gap or spacing between roll faces of an individual pair near the plane of complete solidification is too great, or when this plane lies where the casting is unconfined beyond the curved roll-rack. Heretofore there has been no practical way of locating the plane of complete solidification. If core cracks appeared in the solidified casting, it could only be assumed that the plane lies at a location too far advanced, and the casting speed slowed to make correction, but this may not be effective for eliminating core cracks caused by an excessive gap between rolls.

If the gap between roll faces is excessive at other locations ahead of the plane of complete solidification, the resulting bulging produces tensile forces in the fragile skin at the end faces of a casting. Such forces may cause defects known as "triple cracks" in a casting. If the gap is too little, the casting can pass between the rolls only at the expense of causing additional and possibly excessive loads on the rolls, and possibly harmful tensile forces in the casting.

In most continuous-casting installations the gap between roll faces is measured manually and adjusted with shims only while the casting machine is down for scheduled maintenance, ideally about one turn per week. Measuring and adjusting the roll gap is an awkward operation, often done inaccurately. Heretofore there has been no way of checking the gap other than manually with gauges, and an improperly gapped pair may go unnoticed until the next scheduled maintenance.

An object of our invention is to provide an improved method and mechanism for indicating the location of the plane of complete solidification and at the same time identifying any improperly gapped roll-pairs.

A further object is to provide a method and mechanism for accomplishing the foregoing object in which we equip a plurality of the roll-pairs of a curved roll-rack, (usually arranged in top and bottom clusters of two or three roll per cluster), with means for measuring the load on each such pair, which measurement indicates both the plane of complete solidification, as well as an improperly gapped roll-pair.

The principles of our invention are applicable generally to any continuous-casting machine in which the casting is confined between series of opposed roll-pairs as it travels from the mold while its core solidifies. For illustrative purposes only, we show a machine constructed as shown in Bode and Wrhen U.S. Pat. No. 3,735,848 and in Gallucci and Slamar U.S. Pat. No. 3,752,210, both of common ownership.

Figure 1:
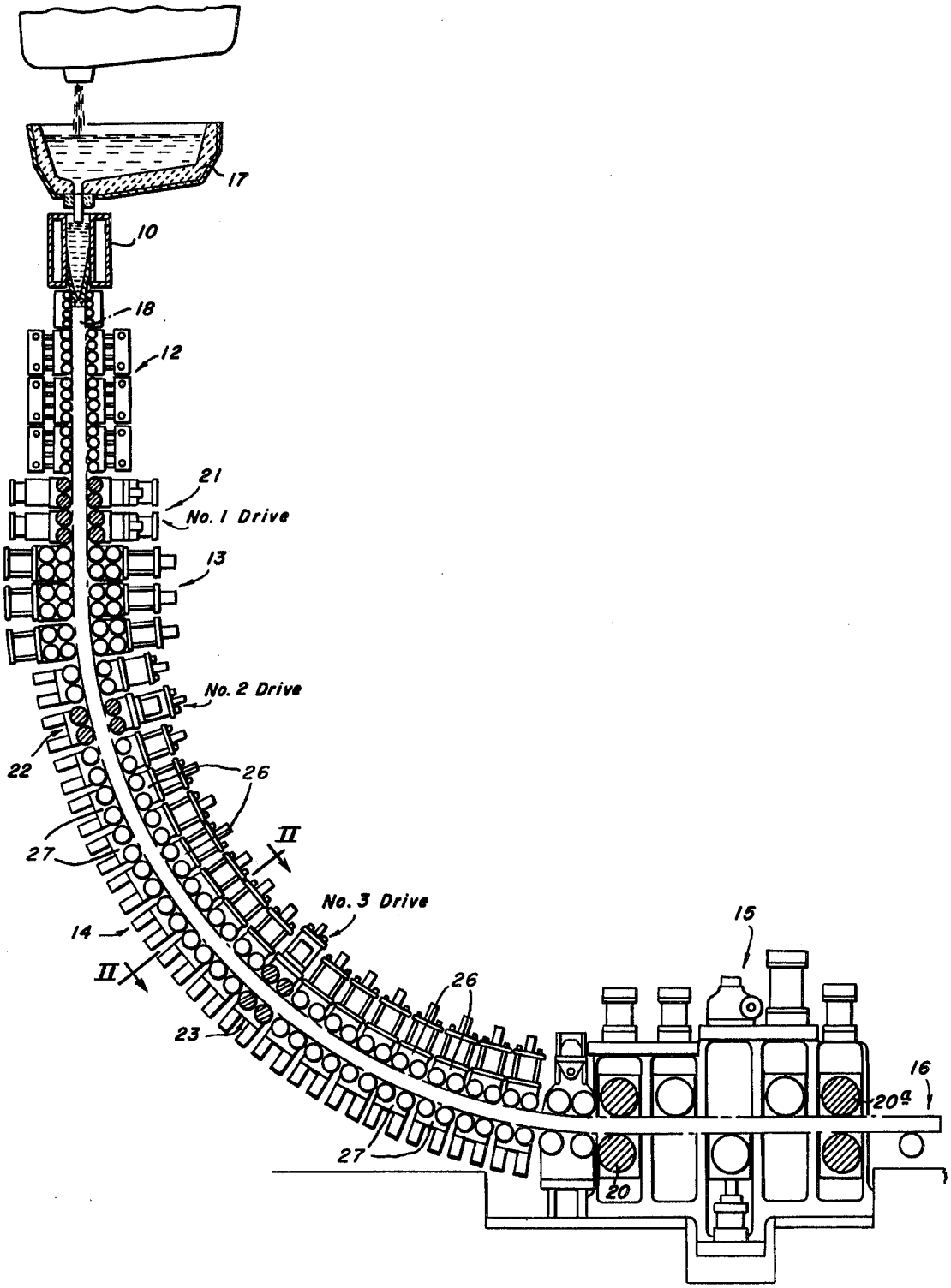
FIG. 1 is a partly diagrammatic side elevational view of a continuous-casting machine of an illustrative construction on which the mechanism of our invention is installed.

As shown in FIG. 1, the illustrated casting machine comprises an open-ended, water-cooled, vertically oscillating mold 10, a guide roll-rack 12, a bending roll unit 13, a curved roll-rack 14, a straightener 15, and a run-out conveyor 16. Liquid metal is poured into mold 10 from a tundish 17, and a partially solidified casting 18 emerges continuously from the bottom of the mold and travels successively through the other aforementioned components. The casting is propelled by speed-regulating drive rolls 20 and **20*a* in the straightener, and by power driven pinch rolls in Nos. 1, 2 and 3 auxiliary drives 21, 22 and 23 respectively, which are located at spaced levels between the guide roll rack 12 and the straightener 15**. This arrangement of drives assures that the casting is not subject to excessive tensile forces, and is explained more fully and claimed in the aforementioned Gallucci and Slamar patent. The other rolls are idlers. As already explained, intense water sprays (not shown) are applied to the surface of the casting after it leaves the mold, and it solidifies throughout its cross section at some location within the curved roll-rack or beyond.

Figure 2:
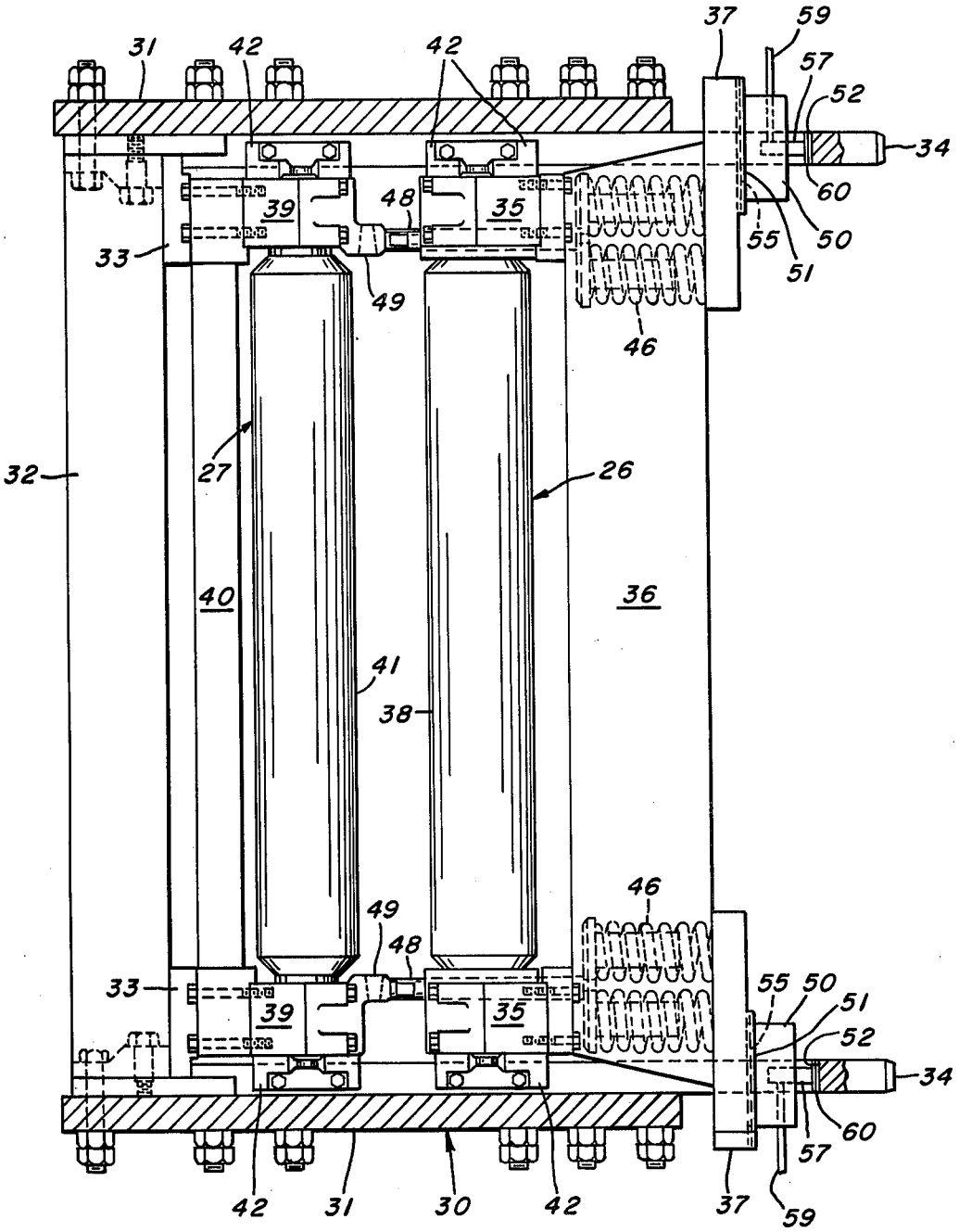
FIG. 2 is a section on line II—II of FIG. 1 showing the way in which we install load cells on a roll cluster of this particular casting machine.

The roll-pairs of the bending roll unit 13, curved roll-rack 14, and the auxiliary drives 21, 22 and 23 are arranged in opposed top and bottom clusters 26 and 27 of two rolls per cluster. FIG. 2 shows the construction of one set of top and bottom clusters of idler rolls of the curved roll-rack. The way in which we apply our invention at the other roll clusters is similar; hence we do not repeat the description. Preferably we apply the invention to all clusters from the bending roll unit 13 to the lowermost rolls of the curved roll-rack inclusive.

As shown in FIG. 2, the curved roll-rack 14 includes a housing 30 in which the clusters 26 and 27 are mounted. The housing is formed of opposed flat side plates 31 and a plurality of transverse box-like base members 32 extending between the edges of the side plates at the convex side of the curved roll-rack behind each set of top and bottom clusters 26 and 27. Each base member 32 carries a respective pair of seats 33 fixed thereto at its opposite sides. A respective pair of opposed straps 34 are fixed to the inside faces of the side plates 31 alongside each pair of clusters. Each top cluster 26 includes a frame formed of opposed chocks 35, spaced transverse plates 36 attached at their opposite ends to the chocks, and blocks 37 fixed to the edges of the plates and extending therebetween at their opposite ends. A pair of top rolls 38 are journaled in suitable bearings within chocks 35. Each bottom cluster 27 includes a frame formed of opposed chocks 39 and a crossbar 40 attached at its opposite ends to the chocks. A pair of bottom rolls 41 are journaled in suitable bearings within chocks 39. The chocks 35 and 39 carry tabs 42 which engage the edges of the proximate straps 34 and thus slidably support the clusters on the straps. The crossbar 40 bears against seats 33. Compression springs 46 are housed in the space between plates 36 of each top cluster frame adjacent opposite ends thereof. The springs act against rods 48 which bear against lugs 49 on the bottom chocks 39. The structure just described is shown in more detail and claimed in the aforementioned Bode and Wrhen patent.

In accordance with our invention, we mount load cell holders 50 in guideways 51 on the outer faces of the respective blocks 37 in place of the keys shown in the Bode and Wrhen patent. The straps 34 have elongated slots 52 which receive the holders 50. Thus the holders serve the same as keys to hold the clusters in the housing, and the springs 46 urge the two clusters of each set apart to the extent permitted by the holders, while providing sufficient pressure on the holders to hold them in position. When the roll clusters are removed for maintenance, an extractor can push the plates 36 and blocks 37 inwardly against the action of spring 46, after which the holders 50 can be slipped out manually.

Figure 3:
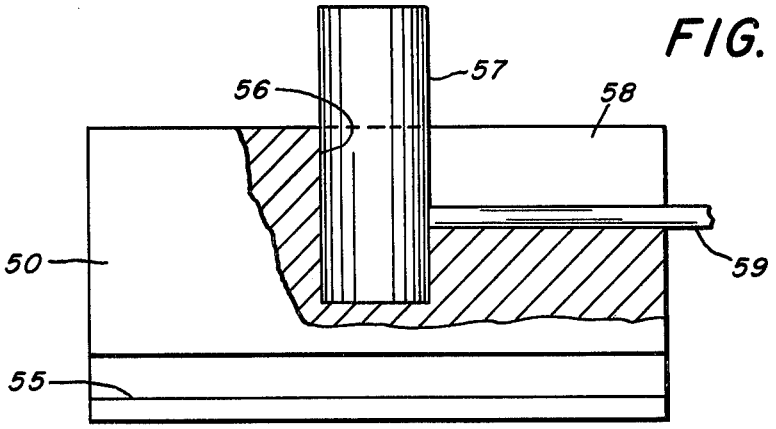
FIG. 3 is a longitudinal sectional view of a load-cell holder and load cell designed for use with the casting machine of FIG. 1.

As shown in FIG. 3, each load cell holder 50 is a block shaped substantially as a rectangular parallelepiped. Near its bottom the block has grooves 55 in its side faces for receiving the guideways 51. The block has a cylindrical bore 56 which extends inwardly from its top face and receives a correspondingly shaped conventional load cell 57. A slot 58 extends from bore 56 to the outer end face of the block. A tube 59 extends from the load cell 57 through slot 58 and carries electric leads which we connect to suitable conventional transducers and read-out devices (not shown). The load cells lie between the respective blocks 50 and the end face of the opening 52 in the strap 34. Accurate spacing or gapping of the roll-pairs is obtained by inserting an appropriate number of shims 60 in the slots 52 between the load cell 57 and strap 34. Each of the two cells measures half the compressive force which the top and bottom roll clusters 26 and 27 exert on a casting 18 confined between them. If this force ever becomes excessive, the load cells are crushed, and thus act as shear keys to prevent damage to the structural components of the casting machine.

During a casting operation the various roll-pairs confine the casting 18 and prevent its skin from bulging. The liquid core exerts a ferrostatic force against the relatively thin skin of the casting tending to push it out. The force tending to bulge the skin reaches a maximum just ahead of the plane of complete solidification, since the ferrostatic head at this plane extends all the way back to the mold. If all the roll-pairs were gapped perfectly, a curve in which force is plotted against the successive roll pairs would rise smoothly from the uppermost roll pair to the roll pair immediately preceding the plane of complete solidification, where the curve would reach a peak. Beyond this plane, the curve would trend downwardly, since there no longer is any force tending to bulge the skin.

Figure 4:
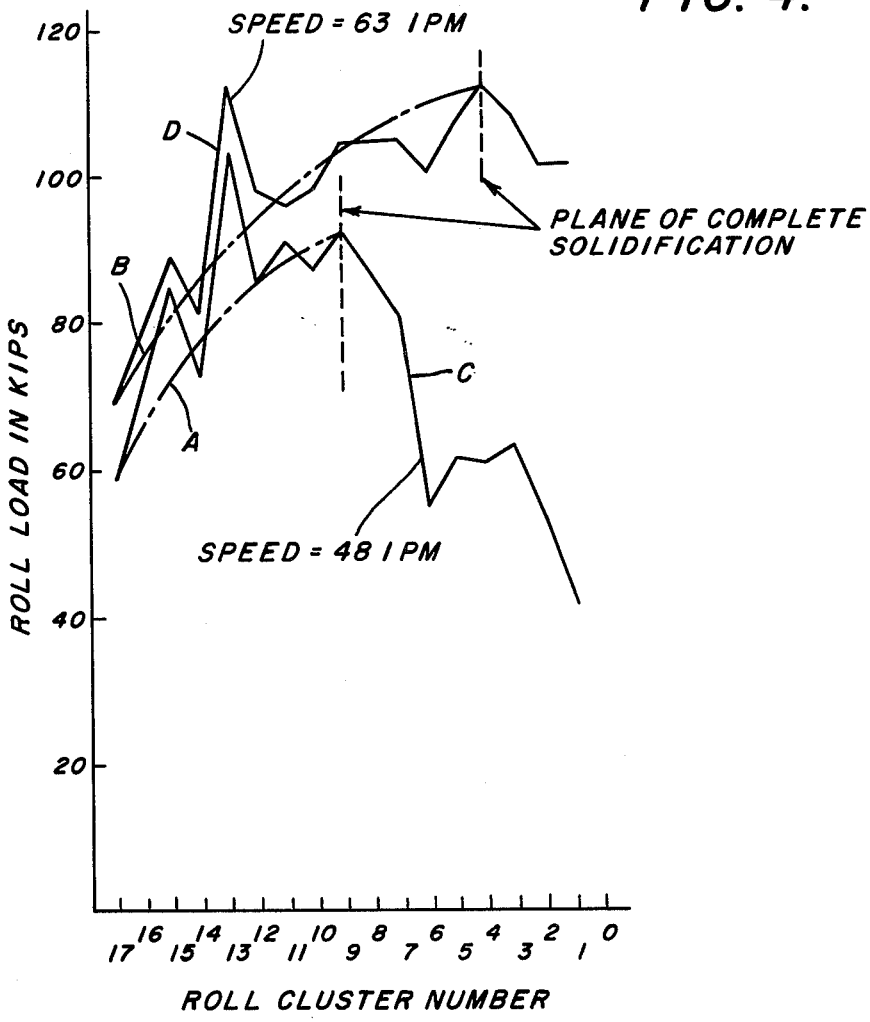
FIG. 4 is a graph which shows typical roll-loads determined on the casting machine of FIG. 1.

In FIG. 4 curves A and B are approximate theoretical curves which might be obtained with a casting machine constructed as shown in FIG. 1 operating at casting speeds of 48 and 63 inches per minute respectively and with all roll-pairs gapped perfectly. The abscissae represent the different roll clusters, cluster no. 17 being uppermost. The ordinates represent the load in kips. The peaks occur at clusters No. 9 and 4 respectively counting upwardly from the lowermost cluster.

In practice the curves show numerous ups and downs which deviate from the theoretical smooth curve. In FIG. 4 curves C and D represent the loads observed in actual tests with a casting machine constructed as shown in FIG. 1 at the aforementioned speeds. The spikes which appear in these curves at clusters No. 12 and 15 indicate the roll pairs of these clusters are too close together and are exerting excessive forces on the casting. The low points which appear at cluster No. 14 indicate the roll pairs of this cluster are too far apart and do not afford adequate confinement for the casting.

In any one casting machine there is a direct relation between the amount of gap or spacing between roll pairs and the compressive force which the rolls exert on the casting. In the present example, we have determined that 0.001 inch of gap is equivalent to 1000 to 2000 pounds of force at each load cell. This fact enables us to correct the gap by observing curves such as C and D of FIG. 4, and removing the proper number of shims from clusters in which the rolls are too close together and adding the proper number to clusters in which the rolls are too far apart. We would correct the spacing of the rolls in cluster No. 12 by removing shims totaling about 0.010 to 0.015 inch in thickness. Thus our invention enables us to determine the need for adjusting the gap between rolls without need for awkward manual gauging, as has been necessary heretofore.

It is to be noted that curves C and D show no further upward trend once they reach peaks at clusters No. 9 and 4 respectively. This indicates that the planes of complete solidification are reached just ahead of these clusters, even though improperly gapped roll-pairs may cause higher peaks to be reached elsewhere. In both instances the plane of complete solidification lies within the curved roll-rack, where the casting is properly confined. If the plane of complete solidification lies beyond the region where the casting is properly confined, core cracks are common. If there are core cracks or triple cracks at an exposed end of a segment cut from the casting, corrosion can take place. Otherwise these defects produce an undesirable laminated structure as the casting is further processed.

From the foregoing description, it is seen our invention affords a simple method and mechanism which both locates the plane of complete solidification of a continuously formed casting, and also indicates any roll-pairs not properly gapped or having other defects. With this information it is a simple matter to operate a continuous-casting machine in a way that locates the plane of complete solidification where the casting is properly confined. It is also simple to spot clusters not operating properly and to make whatever correction is indicated. In the casting machine illustrated, the load cells are readily installed by replacing the original keys with load-cell holders which hold the clusters in place. In other casting machines it is usually possible to install load cells in a similarly convenient fashion.

We are aware that it is known to employ load cells in individual roll-pairs of a continuous-casting machine as a production tool. Gallucci U.S. Pat. No. 3,550,676 shows load cells used to measure the force exerted by power driven pinch rolls on a casting. Gallucci U.S. Pat. No. 3,722,576 shows load cells used to measure the force exerted by a driven fulcrum roll of a straightener or a casting. Gallucci and Wagner U.S. Pat. No. 3,753,461 shows load cells used to measure the force exerted by a driven fulcrum roll of a bending roll unit on a casting. The foregoing patents are all of common ownership. The present invention is to be carefully distinguished therefrom, since it utilizes load cells on a plurality of idler rolls of a curved roll-rack to afford information needed mainly for maintenance and for regulating casting speed to obtain a cast product free of yield-reducing defects. The arrangements shown in the patents cannot yield similar information.

We claim:

1. In a curved roll-rack of a continuous-casting machine, which rack includes a plurality of opposed pairs of idler rolls arranged in top and bottom clusters of at least two rolls per cluster, between which rolls a continuously-formed casting travels as its direction of travel changes from substantially vertical to horizontal, and means supporting said rolls, said casting having only a thin solidified skin and a liquid core as it enters said rack, but solidifying throughout its cross section at a plane below the entry end of said rack, said rolls confining the casting and preventing its skin from bulging as long as the core remains liquid, the combination therewith of mechanism for locating said plane and locating improperly positioned rolls in said rack, said mechanism comprising holders which serve as keys for holding said clusters in said supporting means, and load cells mounted on the respective holders of a plurality of the roll-pairs along the length of said rack for indicating the compressive force exerted by each of said roll pairs on the casting.

2. A curved roll-rack as defined in claim 1 in which excessive loads on said rolls crush said load cells to avoid damage to structural components of the rack.

3. A curved roll-rack as defined in claim 1 comprising in addition shims behind said load cells for adjusting the gap between faces of the roll-pairs, the loads measured by said load cells affording information needed to install the correct number of shims for proper gapping of the rolls.

4. In a continuous casting machine which includes:

an open-ended water-cooled mold from the lower end of which a continuously formed casting emerges;

a curved roll-rack below said mold including a plurality of opposed pairs of idler rolls arranged in top and bottom clusters of at least two rolls per cluster, between which rolls the casting travels as its direction of travel changes from substantially vertical to horizontal, and means supporting said rolls;

said casting having only a thin solidified skin and a liquid core as it leaves said mold, but solidifying throughout its cross section at a plane spaced below said mold;

said core exerting a progressively increasing ferrostatic pressure on said skin down to said plane;

said rolls confining said casting and preventing its skin from bulging as long as its core remains liquid;

the combination therewith of mechanism for locating said plane, said mechanism comprising:

holders which serve as keys for holding said clusters in said supporting means; and respective load cells mounted in said holders of a plurality of the roll pairs between the holders and the supporting means for indicating the compressive force exerted by each of the roll-pairs on the casting.

5. A combination as defined in claim 4 in which said mechanism also indicates any roll-pairs which are improperly gapped by showing that the load thereon departs from the norm.

6. A combination as defined in claim 4 comprising in addition shims between said load cells and said supporting means for adjusting the gap between faces of the roll pairs, the loads measured by said load cells affording the measurement needed to install the correct number of shims for proper gapping of the rolls.

7. In a continuous-casting operation in which a casting emerges from the bottom of a mold and travels between a plurality of opposed pairs of rolls, said casting having only a thin solidified skin and a liquid core as it leaves the mold, but solidifying throughout its cross section at a plane spaced below the mold, said rolls confining said casting and preventing its skin from bulging as long as the core remains liquid, the combination therewith of a method of locating said plane, said method comprising measuring the compressive loads at a plurality of the roll-pairs, and comparing the measurements at the different pairs to determine the pair beyond which there is no further upward trend in the load.

8. A method as defined in claim 7 in which improperly gapped rolls are located by loads measured and departing from a norm.

9. A method as defined in claim 8 in which the loads on the roll-pairs are plotted to furnish a curve showing both the pair where there is no further upward trend and roll pairs preceding this pair where the load departs from the norm.

10. A method as defined in claim 8 in which rolls of each pair are gapped by inserting shims behind the roll supporting means and the correct number of shims to obtain proper gapping is determined by observing the load on each pair.

11. A method as defined in claim 8 in which said plane is located within a curved roll-rack in which the direction of travel of said casting is changed from substantially vertical to horizontal.

* * * * *